US006806845B2

(12) United States Patent
Fund et al.

(10) Patent No.: US 6,806,845 B2
(45) Date of Patent: Oct. 19, 2004

(54) TIME-DELAYED DIRECTIONAL BEAM PHASED ARRAY ANTENNA

(75) Inventors: Douglas Eugene Fund, Lenexa, KS (US); John William Cable, Kansas City, MO (US); Tony Myron Cecil, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 10/342,581

(22) Filed: Jan. 14, 2003

(65) Prior Publication Data

US 2004/0135736 A1 Jul. 15, 2004

(51) Int. Cl.[7] ..... H01Q 21/00
(52) U.S. Cl. ..... 343/853; 343/757
(58) Field of Search ..... 343/757, 853, 343/878, 895; 342/368, 375

(56) References Cited

U.S. PATENT DOCUMENTS

| | | | | |
|---|---|---|---|---|
| 4,323,900 A | | 4/1982 | Krall et al. | 343/700 MS |
| 4,527,163 A | | 7/1985 | Stanton | 343/700 MS |
| 5,138,331 A | | 8/1992 | Josypenko | 343/895 |
| 5,485,170 A | | 1/1996 | McCarrick | 343/895 |
| 5,594,461 A | | 1/1997 | O'Neill, Jr. | 343/895 |
| 5,604,972 A | | 2/1997 | McCarrick | 29/600 |
| 5,856,805 A | * | 1/1999 | Page | 342/375 |
| 6,002,365 A | * | 12/1999 | Page | 342/375 |
| 6,049,305 A | | 4/2000 | Tassoudji et al. | 342/357.16 |
| 6,212,413 B1 | | 4/2001 | Kiesi | 455/575 |
| 6,243,052 B1 | * | 6/2001 | Goldstein et al. | 343/895 |
| 6,252,562 B1 | * | 6/2001 | Diez | 343/895 |
| 6,380,908 B1 | * | 4/2002 | Andrews et al. | 343/853 |
| 6,552,695 B1 | * | 4/2003 | Strickland | 343/895 |

* cited by examiner

*Primary Examiner*—Hoang V. Nguyen
(74) *Attorney, Agent, or Firm*—Hovey William LLP

(57) ABSTRACT

An antenna comprising a phased array of quadrifilar helix or other multifilar antenna elements and a time-delaying feed network adapted to feed the elements. The feed network can employ a plurality of coaxial cables that physically bridge a microstrip feed circuitry to feed power signals to the elements. The cables provide an incremental time delay which is related to their physical lengths, such that replacing cables having a first set of lengths with cables having a second set of lengths functions to change the time delay and shift or steer the antenna's main beam. Alternatively, the coaxial cables may be replaced with a programmable signal processor unit adapted to introduce the time delay using signal processing techniques applied to the power signals.

18 Claims, 5 Drawing Sheets

TIME-DELAYED DIRECTIONAL BEAM PHASED ARRAY ANTENNA

FEDERALLY SPONSORED RESEARCH OR DEVELOPMENT PROGRAM

The present invention was developed with support from the U.S. government under Contract No. DE-AC04-01AL66850 with the U.S. Department of Energy. Accordingly, the U.S. government has certain rights in the present invention.

BACKGROUND OF THE INVENTION

1. Field of the Invention

The present invention relates broadly to steerable antennas having phased arrays of quadrifilar or other multifilar antenna elements. More particularly, the present invention concerns an antenna comprising a phased array of quadrifilar or other multifilar antenna elements (e.g., quadrifilar helix elements) fed power signals by a time-delaying mechanism (e.g., coaxial cables of differing lengths, or a signal processing unit comprising a microcontroller or microprocessor), wherein the time-delaying mechanism functions to cause the propagation time of the power signals to change and thereby shifts or steers the antenna's main beam.

2. Description of the Prior Art

It is often desirable, particularly in, for example, satellite, radar, and various military applications, to have and use a low cost lightweight microwave communication antenna capable of maximum range coverage and fast tracking times. Unfortunately, prior art antennas are extremely heavy and cumbersome and do not provide the desired degree of performance.

Phased array antennas are well-known and comprise several antenna elements grouped together, typically spaced apart from one another in an organized positional arrangement which can be linear, two-dimensional, or three-dimensional. In a two-dimensional array, the elements can be positioned, for example, on a rectangularly spaced grid, a triangularly spaced grid, or a circularly spaced grid. This organized arrangement results in a desirable radiation beam pattern, typically consisting of a single main beam or main lobe, which is dependent on the amplitude and phase, either transmitted or received, of the power signal of each element. It will be appreciated, however, that the array needs not be organized in any particular pattern. Thus, the array can be arranged in a so-called "thinned array", wherein some of the elements are not needed and are eliminated, thereby resulting in a somewhat disorganized array configuration. Phased array antennas are preferred over standard single antennas because they provide higher gain capabilities with a narrower main beamwidth and increased tracking speeds using rapid electronical beam steering.

Quadrifilar helix antennas (QHAs) are also well-known and comprise four equal length electrical conductors or arms spaced 90° apart and wrapped in helical form around a fixed radius. In recent years, the QHA has developed into an excellent radiator for use in mobile and weather satellite applications. The QHA is similar to other antennas in that the crossed dipole and the patch radiate similarly shaped patterns. The QHA is preferred, however, for a number of reasons, including, for example, that it requires no ground plane, which allows for substantially reducing its weight and size and makes it ideal for low-weight applications, such as, for example, on-board satellite communication applications. Furthermore, the QHA's radiation pattern can be controlled by varying structural parameters, which is ideal for design purposes. Additionally, the QHA's elevation radiation pattern has a wide circular polarized beam, making it an excellent radiator for satellite communications tracking systems.

In the prior art, QHAs are used for communications applications, but only in single unit, compact installations. Phased array antennas incorporating multiple QHA elements have not been used because it is thought that the omnial characteristics of the QHA would result in inefficiency in a phased array configuration. Furthermore, phase-shifting involved in the operation of a QHA introduces additional complications into the design of a phased array antenna. Thus, directional antennas, such as, for example, horn or reflector-type antennas, are deemed more feasible for use in a phased array antenna.

Due to the above-identified and other problems and disadvantages in the art, a need exists for an improved phased array antenna.

SUMMARY OF THE INVENTION

The present invention overcomes the above-described and other problems and disadvantages in the prior art by providing an antenna comprising a phased array of quadrifilar or other multifilar antenna elements fed power signals by a time-delaying mechanism, wherein the time-delaying mechanism functions to cause the propagation time of the power signals to change and thereby shifts or steers the antenna's main beam. As described herein, the antenna elements are QHA elements, and the time-delaying mechanism includes replaceable coaxial cables of differing lengths adapted to feed each element with a separate time-delayed power signal, either transmitted or received. Alternative and equally suitable time-delaying mechanisms may be implemented using software, firmware, hardware, or any combination thereof, and may be based upon such devices as logic gates, microcontrollers, or microprocessors, rather than replaceable coaxial cables. By changing the time delay or shifting the phase angle of the elements' feed signals, the individual radiation patterns formed by the elements combine and interact with one another to produce the main beam which is shifted at a desired angle.

Each element includes four identical helical-shaped electrically conducting arms spaced 90° apart at a fixed radius. Different radiation patterns can be achieved by feeding the elements with different phase-shifting configurations. A cardiod-shaped radiation pattern, for example, can be achieved if each element is provided with a power signal having an identical amplitude but a 90° shift in phase relative to each other element.

Each element is constructed on a small PCB which is tightly-rolled and encased in a polymer-type cylindrical housing. The arms of the element are constructed on the PCB as four etched copper traces which, when the PCB is rolled into cylindrical form, produce the helical shape of the QHA. Each element is provided with a built-in quadrature phase-shifting feed network implemented as a microstrip phase-shifting circuitry etched on the inside of the PCB cylinder, which advantageously makes additional phase-shifting components unnecessary. This built-in phase-shifting feature also allows for an overall reduction in the number of required interconnects.

The elements are mounted on a main PCB which is constructed from the RF dielectric material. The PCB has a first side used as both a ground plane and as a mounting foundation for the sixteen elements, and a second side used to provide a microstrip feed circuitry for feeding the elements. The microstrip feed circuitry use an equal line-length planar feed geometry etched to a +/−5 mil width tolerance and adapted to provide an equal power feed delay to the individual elements. Five three-branch Wilkinson power dividers are used to further ensure that equal power is delivered to each element.

The time-delaying mechanism includes four time-delay feed lines, with each feed line having four coaxial cables, such that each element is fed by a respective one of the coaxial cables. The coaxial cables bridge the microstrip feeding circuitry to the elements and provide, respectively, a 0, t, 2t, and 3t time delay. By swapping coaxial cables of different lengths, various time delays can be configured and the main beam can be steered. More specifically, uniformly altering the physical lengths of the coaxial cables results in corresponding alterations in the time delay to the elements. By changing the lengths of the coaxial cables, the propagation of the power signal is either increased or decreased, causing the individual elements to take on various beam shift angles and thereby resulting in a shift in the antenna's main beam.

Thus, it will be appreciated that the antenna of the present invention provides a number of substantial advantages over the prior art, including, for example, that, by incorporating QHA elements, it advantageously provides a higher gain and a narrower beamwidth. Furthermore, the antenna advantageously provides better circular polarization characteristics, and lower sensitivity to a ground plane, which allows for weight and cost-saving elimination of the ground plane. Additionally, the antenna can be manufactured at a substantially lower cost than most other antennas with similar radiating characteristics. Additionally, the main beam can scan electronically at very high speeds by varying the time delay. For these reasons, use of the antenna in the commercial, military, industrial, scientific, and medical (ISM) band provides excellent circular polarization in a steerable format. Applications for the antenna include commercial satellite, mobile base station, and indoor wireless communication applications.

These and other important features of the present invention are more fully described in the section titled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENTS

Figure 1:
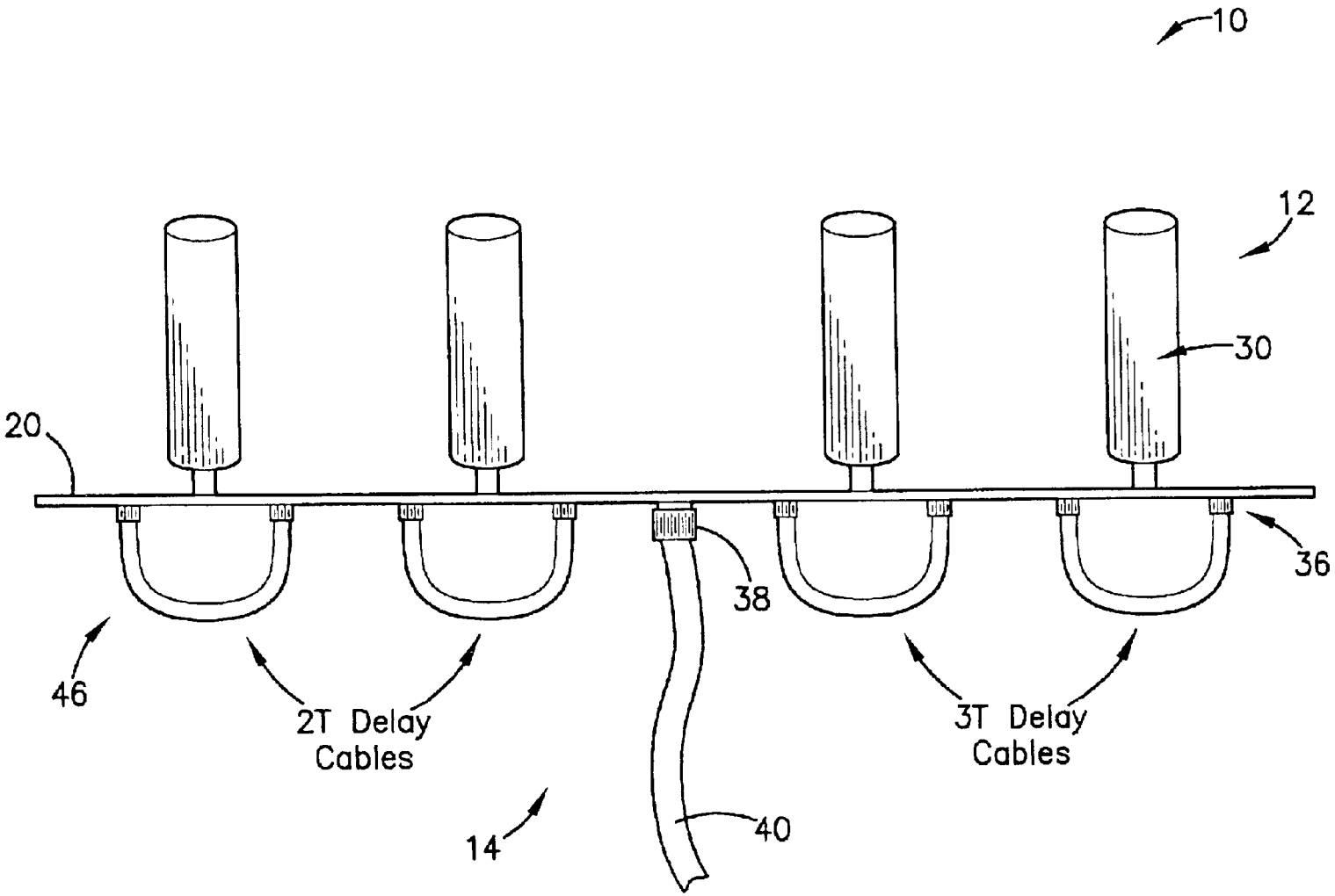
FIG. 1 is an elevational view of a preferred embodiment of the quadrifilar helix phased array antenna of the present invention.

Referring to FIG. 1, a quadrifilar phased array antenna 10 is shown constructed in accordance with a preferred first embodiment of the present invention. The antenna 10 broadly comprises a plurality of QHA elements 12 cooperating in a phased array relationship and provided with an incrementally time-delaying mechanism 14 in the form of a feed network for steering the main beam of the antenna 10. By changing the time delay or shifting the phase angle of the elements' feed signals, the individual radiation patterns formed by the elements 12 interact with one another to result in the combined main beam being shifted or steered to a desired angle.

Figure 5:
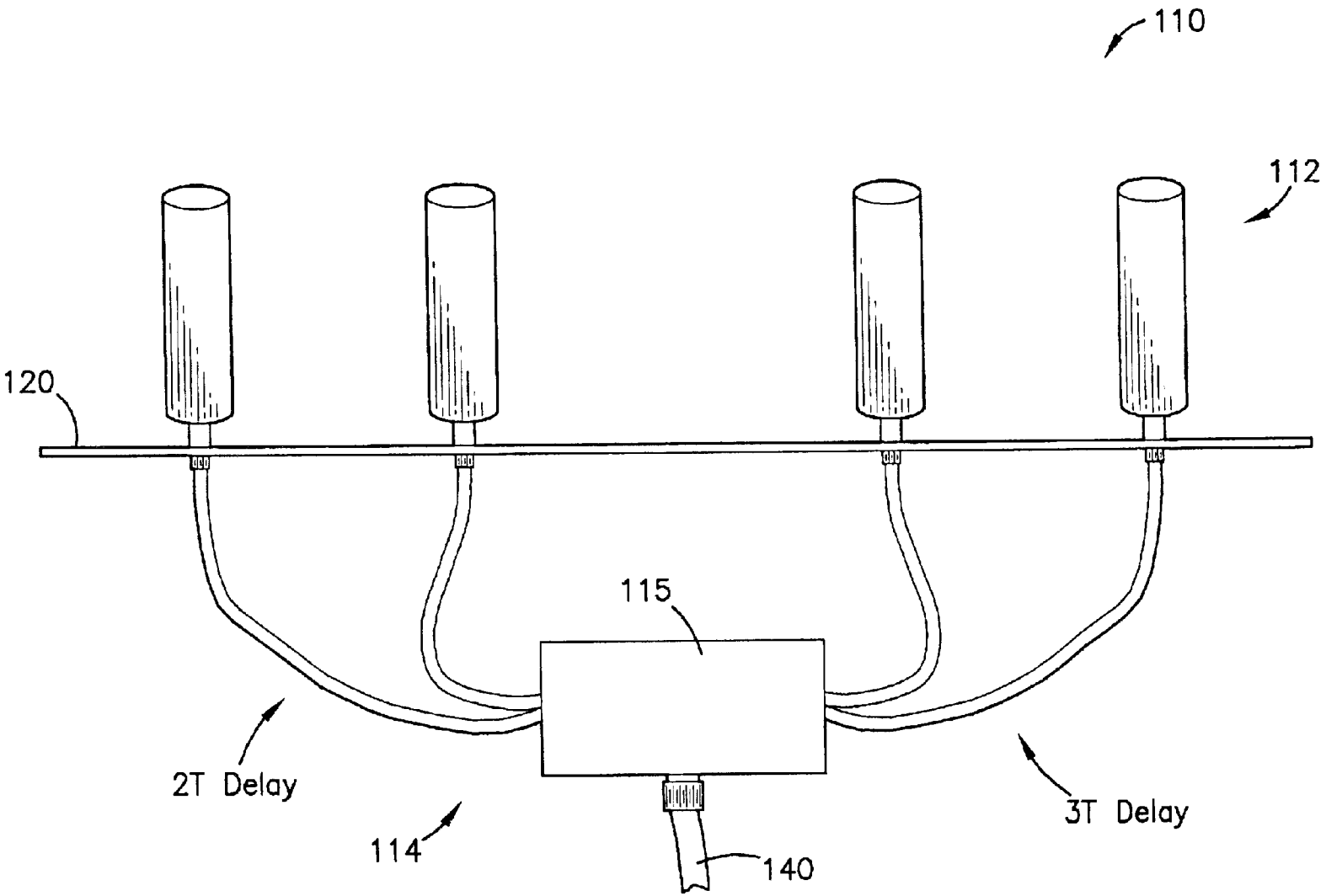
FIG. 5 is an elevation view of a preferred alternative embodiment of the quadrifilar helix phased array antenna of the present invention.

Though the elements 12 are described herein as QHA elements, they may alternatively be any quadrifilar or other multifilar element. Similarly, though the time-delaying mechanism 14 is described herein as including coaxial cables of differing lengths, other alternative mechanisms or methods for achieving the desired time delay may be used, including, for example, digital signal processing (DSP) techniques. One possible preferred alternative embodiment is shown in FIG. 5 and discussed in detail below. It should also be noted that, as described herein, the antenna 10 is reciprocal, meaning that its transmit and receive signals are equal as long as all other antenna parameters are held constant.

As illustrated, the antenna 10 broadly comprises sixteen of the QHA elements 12 and the time-delaying feed network 14. Each element 12 includes four equal length electrically conductive arms spaced 90° apart and wrapped helically around a fixed radius. The elements' general physical parameters, for wavelength ($\lambda$)=0.1244 meters and resonant frequency (f)=2.45 Ghz, are as follows:

axial length of element ($L_{ax}$)=0.0143 meters, length of helical element ($L_{ele}$)=0.0476 meters, radius of helix=0.0064 meters, and number of turns=0.25.

Spacing (d) of the elements 12 on the PCB 20 is equal to approximately 0.8$\lambda$, as shown by the following equation:

$$d=0.8\times0.1244 \text{ meters}=0.0995 \text{ meters}.$$

Each element 12 is itself constructed on a small PCB which is tightly-rolled and encased in a cylindrical housing 30 constructed from a polymer-type material. Both sides of the small PCB are solder-coated for conveniently securing components during the assembly process. The arms of the element 12 are constructed on the small PCB as four etched copper traces which, when the PCB is rolled into cylindrical form, produce the helical shape of the QHA.

Each element 12 is provided with a built-in quadrature phase-shifting feed network implemented as microstrip phase-shifting circuitry etched on the inside of the cylinder formed by the rolled, small PCB, making additional phase-shifting components unnecessary. This built-in phase-shifting feature advantageously allows for an overall reduction in the number of required interconnects.

Figure 2:
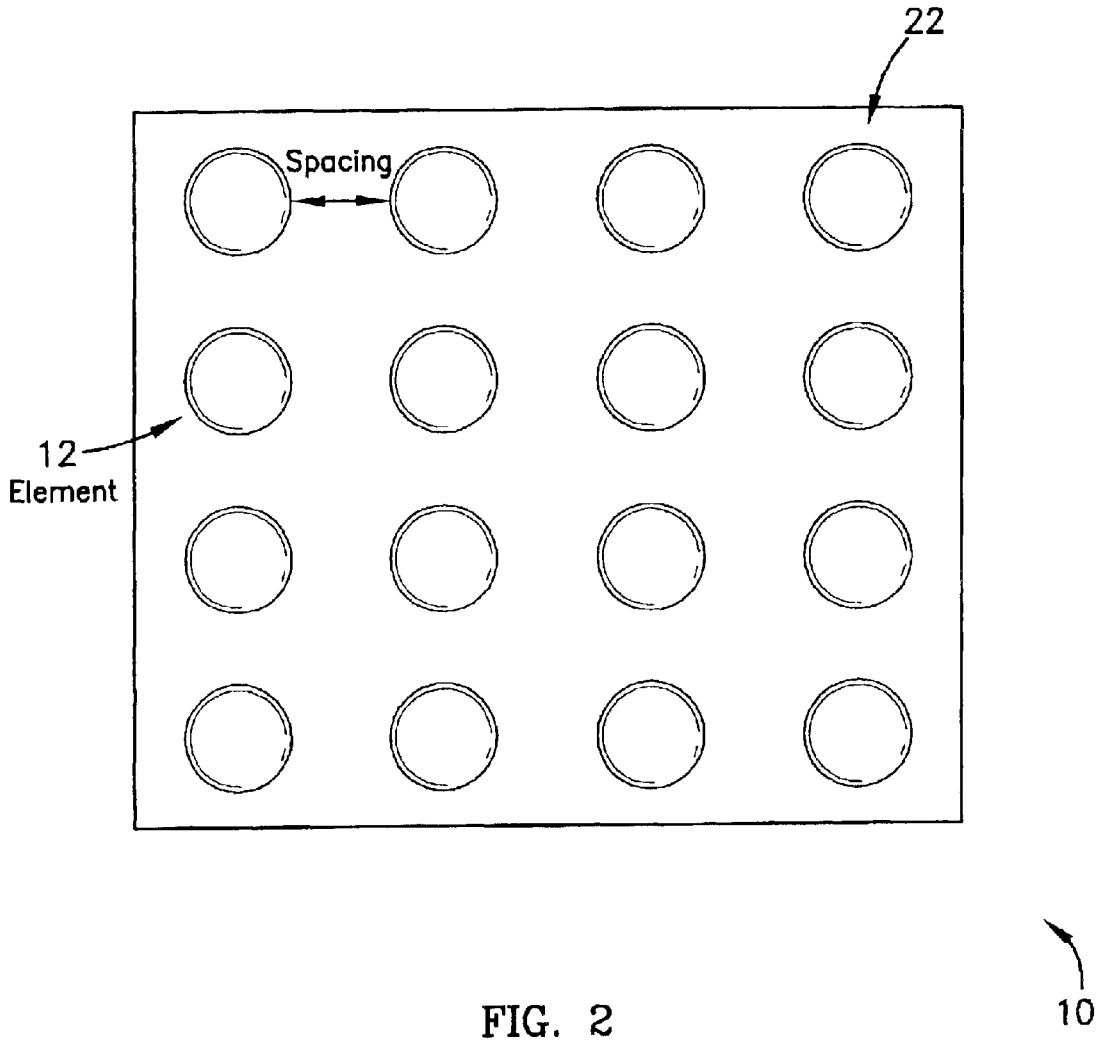
FIG. 2 is a diagram showing a matrix-type arrangement of a plurality of quadrifilar helix antenna elements of the antenna of FIG. 1.

Referring also to FIG. 2, the elements 12 are effectively arranged rectangularly in four columnar linear phased arrays 22, with each linear array 22 including four of the elements 12. This four-by-four matrix arrangement of the elements 12 limits the antenna 10 to steering the main beam in only one dimension. It will be appreciated, however, that the present invention is readily adaptable by one with ordinary skill in the art to produce an antenna capable of steering in two dimensions.

Figure 3:
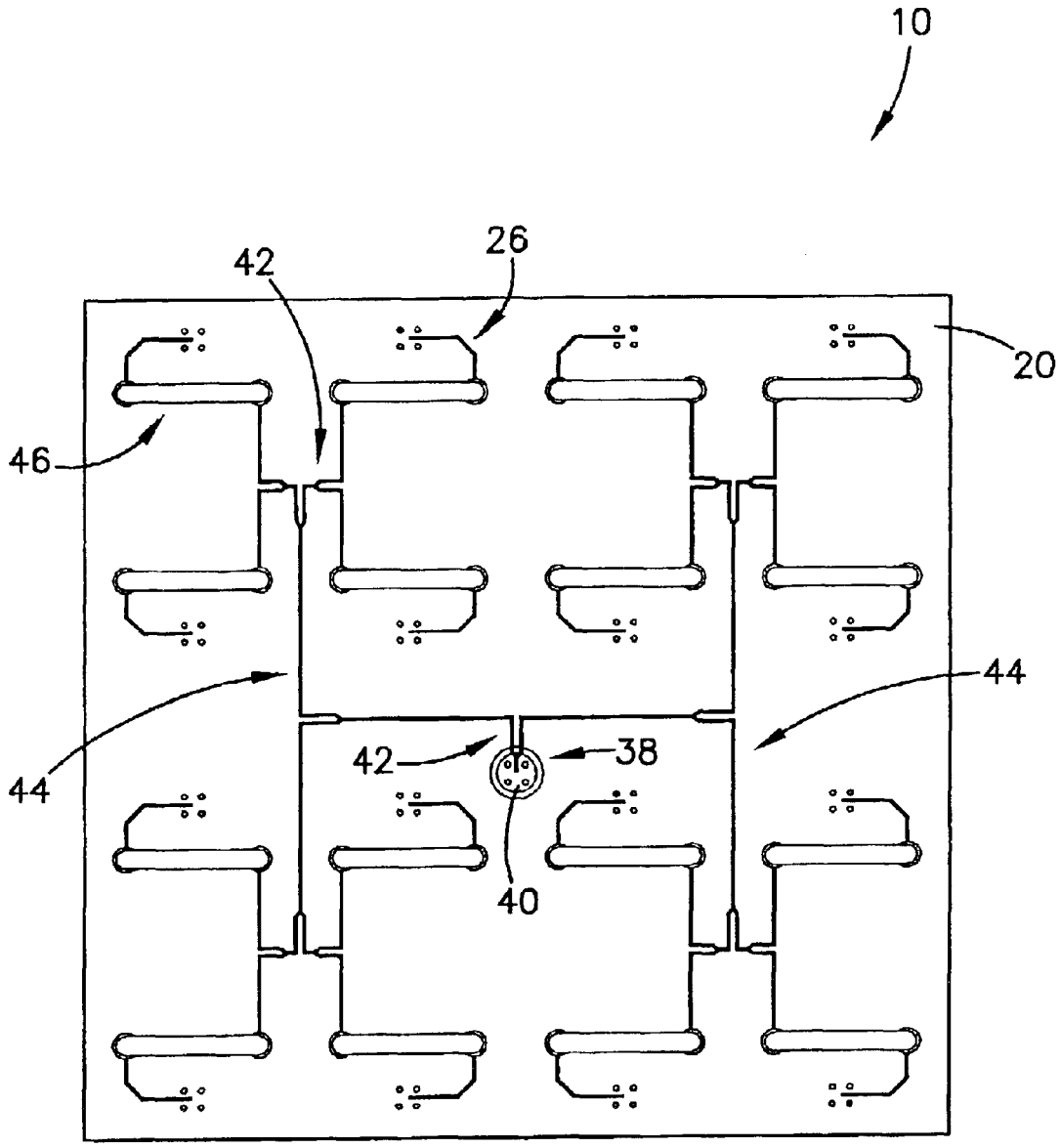
FIG. 3 is a plan view of a microstrip feed circuitry component of the antenna of FIG. 1.

Referring also to FIG. 3, the elements 12 are mounted on a main PCB 20 constructed from an RF-type dielectric material. The main PCB 20 has a first side used as both a ground plane and as a mounting foundation for the sixteen elements 12, and a second side provided with microstrip feed circuitry 26. The ground plane is used in this embodiment as a barrier to better isolate the microstrip feed circuitry 26 and components against coupling effects from the elements 12. The main PCB 20 measures 0.3302 meters by 0.127 meters. The microstrip feed circuitry 26 provides an equal power feed delay to the individual elements 12. The microstrip feed circuitry 26 uses an equal line-length planar feed geometry, and the circuitry's symmetrical, tree-like layout is etched with a precise +/−5 mil width tolerance. Other parameters of the main PCB 20 and its signal paths are as follows:

dielectric constant=10.2 board thickness=30 mils copper thickness=1.34 mils microstrip width=22.4 mils

The entire feed circuit 14 is designed for matching networks at 50 Ohms, using time-delay coaxial cables 34 (described below), connected to the microstrip feed circuitry 26 of the main PCB 20 through a plurality of subminiature assembly (SMA) connectors 36. A center SMA connector 38 is located on the main PCB 20 to provide a main power feed through a flexible main power feed coaxial cable 40 connected to a power source. Additionally, five three-branch Wilkinson power dividers 42 are used to ensure equal power on each feed branch.

Broadly, the time delay is accomplished by altering the travel time of the power signals of the feed path to the individual elements 12. This can be done by physically increasing of decreasing the length of the signal path. Alternatively, the power signals can be delayed using other mechanisms or methods, including, for example, DSP implemented in software, firmware, hardware, or any combination thereof, and based upon such devices as logic gates, microcontrollers, or microprocessors. Furthermore, in most cases, signal phase-shifting in the frequency domain has the same effect as time delay in the time domain.

Figure 4:
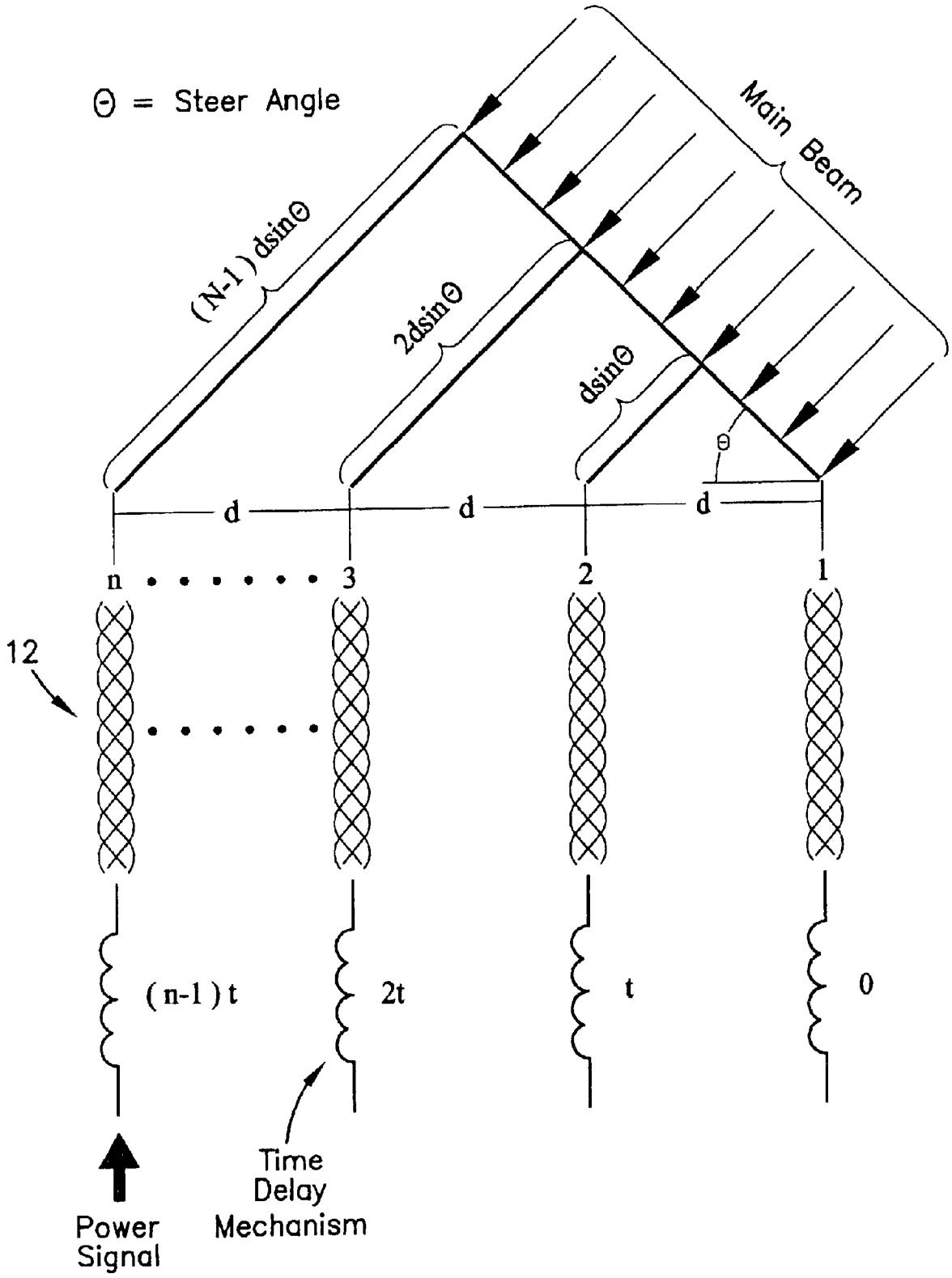
FIG. 4 is a representation of a time delay effect occurring in the antenna of FIG. 1.

In the present embodiment, the feed network 14 includes four time-delay feed lines 44, with each feed line 44 feeding one of the linear arrays 22 and having four coaxial cables 46. Thus, there are sixteen coaxial cables 46 in total, one to feed each element 12. Referring also to FIG. 4, the feed lines 44 provide, respectively, a 0, t, 2t, and 3t time delay, where t=97 ps relative to the 0 time delay reference. The coaxial cables 46 are connected to the open microstrip feed circuitry 42 to bridge the open circuit using the same type of SMA connectors 36 as the main power feed connector 38. By swapping coaxial cables 46 of different lengths, various time delays can be achieved and the main beam can be steered. More specifically, uniformly altering the physical lengths of the coaxial cables 46 results in a corresponding alteration in the time delay to the elements 12. More specifically, uniformly altering the physical lengths of the coaxial cables 46 results in corresponding alterations in the time delay to the elements. By changing the lengths of the coaxial cables 46, the propagation of the power signal is either increased or decreased, causing the individual elements 12 to take on various beam shift angles and thereby resulting in a shift in the antenna's main beam.

The time delay of the 0° reference coaxial cable is determined by feeding a source signal through one end of the cable and terminating the other end of the cable with a known mismatched resistive load. The signal is reflected when it reaches the load and propagates back to the source end, whereat the propagation time can be measured. Thereafter, by setting the reference coaxial cable to $t_{ref}=0$, the following calculation can be used to determine the shift angle of the main beam using the incremental time delay measurement ($t_{delay}$) relative to the reference coaxial cable $t_{ref}$:

$$\theta_0-90^\circ=\sin^{-1}((t_{delay}c)/d),$$

where c=speed of light, and d=spacing between elements.

The physical lengths of the other coaxial cables or circuit paths can be calculated once the length of the reference coaxial cable is determined. The coaxial cable lengths are as follows:

0° cable (0 time delay (reference cable))
- 0° physical length=0.0700 meters;

−90° cable (t time delay)
- −90° electrical length ($l_e$)=0.0306 meters,
- −90° physical length (l)=0.0206 meters,
- −90° coaxial physical length=0.0906 meters;

−180° cable (2t time delay)
- −180° electrical length ($l_e$)=0.0612 radians/meter,
- −180° physical length (l)=0.0413 meters,
- −180° coaxial physical length=0.1086 meters; and −280° cable (3t time delay)
- −270° electrical length ($l_e$)=0.0918 radians/meter,
- −270° physical length (l)=0.0619 meters,
- −270° coaxial physical length=0.1317 meters.

Referring also to FIG. 5, as mentioned above, an alternative preferred embodiment of the antenna 110 is shown which operates substantially similar to the above-described preferred embodiment but for the following differences. The antenna 110 continues to include the elements 112 mounted on the PCB 120, but the coaxial cables 46 are replaced in the time-delaying feed network 114 by a programmable signal processor unit 115. The main power cable 140 is electrically connected to the signal processor unit 115, and the signal processor unit 115 is electrically connected to each element 112 by a single wire 117. The signal processor unit 115 is programmable to provide the time delay for steering the main beam, and may be implemented using any suitable mechanism or method, including, for example, DSP implemented in software, firmware, hardware, or any combination thereof, and may be based upon such devices as logic gates, microcontrollers, or microprocessors.

From the preceding description, it will be appreciated that the antenna 10 of the present invention provides a number of substantial advantages over the prior art, including, for example, that, by incorporating QHA elements 12, it advantageously provides a higher gain and a narrower beamwidth. Furthermore, the antenna 10 advantageously provides better circular polarization characteristics, and lower sensitivity to a ground plane, which allows for weight and cost-saving elimination of the ground plane. Additionally, the antenna 10 can be manufactured at a substantially lower cost than most other antennas with similar radiating characteristics. Additionally, the main beam can scan electronically at very high speeds by varying the time delay. For these reasons, use of the antenna 10 in the commercial, military, industrial, scientific, and medical (ISM) band provides excellent circular polarization in a steerable format. Applications for the antenna 10 include commercial satellite, mobile base station, and indoor wireless communication applications.

Although the invention has been described with reference to the preferred embodiments illustrated in the drawings, it is noted that equivalents may be employed and substitutions made herein without departing from the scope of the invention as recited in the claims. For example, it will be appreciated that the phased array may include more or less than and is not limited to the sixteen elements described herein. Furthermore, as mentioned, the elements need not be arranged in a rectangular matrix configuration; triangular or circular configurations or thinned-array or three-dimensions configurations, for example, may alternatively be used. Additionally, as mentioned, the antenna described herein, being limited to beam steering in one dimension, is readily adaptable by one with ordinary skill in the art to allow for beam steering in two or three dimensions. Additionally, the QHA elements may be constructed using any suitable method, and are not limited to the construction method disclosed herein. Additionally, as mentioned, time delay can be accomplished using any suitable alternative mechanism or method, including, for example, DSP, and is not limited to the mechanisms or methods disclosed herein.

Having thus described the preferred embodiment of the invention, what is claimed as new and desired to be protected by Letters Patent includes the following:

1. An antenna comprising:

a plurality of elements cooperating as a phased array; and a feed network adapted to feed the plurality of elements, there being a first part of the feed network adapted to provide a first changeable time delay to a first portion of the plurality of elements, and a second part of the feed network adapted to provide a second changeable time delay to a second portion of the plurality of elements, wherein changing the first changeable time delay and the second changeable time delay results in a shift of the antenna;

wherein the first part of the feed network includes a first coaxial cable having a first length that determines the first changeable time delay, and the second part of the feed network includes a second coaxial cable having a second length that determines the second changeable time delay.

2. An antenna comprising:

a plurality of elements cooperating as a phased array; and a feed network adapted to feed the plurality of elements, there being a first part of the feed network adapted to provide a first changeable time delay to a first portion of the plurality of elements, and a second part of the feed network adapted to provide a second changeable time delay to a second portion of the plurality of elements, wherein changing the first changeable time delay and the second changeable time delay results in a shift of the antenna;

wherein the plurality of elements are mounted on a main board presenting a first surface and a second surface, with the first surface providing both a ground plane and a mounting location for the plurality of elements, and the second surface providing a microstrip feed circuitry portion of the feed network.

3. The antenna as set forth in claim 2, wherein the microstrip feed circuitry uses an equal line-length planar feed geometry.

4. The antenna as set forth in claim 2, wherein the first part of the feed network includes a first coaxial cable having a first length that determines the first changeable time delay and that bridges a first section of the microstrip feed circuitry, and the second part of the feed network includes a second coaxial cable having a second length that determines the second changeable time delay and that bridges a second section of the microstrip feed circuitry.

5. The antenna as set forth in claim 4, wherein the first coaxial cable is connected to the first section of the microstrip feed circuitry using a first subminiature assembly connector, and the second coaxial cable is connected to the second section of the microstrip feed circuitry using a second subminiature assembly connector.

6. An antenna comprising:

a plurality of quadrifilar helix antenna elements cooperating as a phased array; and a feed network adapted to feed the plurality of quadrifilar helix antenna elements, with the feed network including a first coaxial cable having a first length that provides a first changeable time delay to a first portion of the plurality of quadrifilar helix antenna elements, and a second coaxial cable having a second length that provides a second changeable time delay to a second portion of the plurality of quadrifilar helix antenna elements, with the second changeable time delay being an integer multiple of the first changeable time delay, wherein changing the first changeable time delay and the second changeable time delay results in a shift of the antenna.

7. The antenna as set forth in claim 6, wherein each of the quadrifilar helix antenna elements includes a phase-shifting circuit.

8. The antenna as set forth in claim 7, wherein the plurality of quadrifilar helix antenna elements are mounted on a main board presenting a first surface and a second surface, with the first surface providing both a ground plane and a mounting location for the plurality of quadrifilar helix antenna elements, and the second surface providing a microstrip feed circuitry portion of the feed network.

9. The antenna as set forth in claim 8, wherein the microstrip feed circuitry uses an equal line-length planar feed geometry.

10. The antenna as set forth in claim 8, wherein the first coaxial cable bridges a first section of the microstrip feed circuitry, and the second coaxial cable bridges a second section of the microstrip feed circuitry.

11. The antenna as set forth in claim 10, wherein the first coaxial cable is connected to the first section of the microstrip feed circuitry using a first subminiature assembly connector, and the second coaxial cable is connected to the second section of the microstrip feed circuitry using a second subminiature assembly connector.

12. The antenna as set forth in claim 6, wherein the feed network includes a power divider circuit adapted to provide equal power to each quadrifilar helix antenna element.

13. An antenna comprising:

a plurality of quadrifilar helix antenna elements cooperating as a phased array;

a main board presenting a first surface and a second surface, with the first surface providing both a ground plane and a mounting location for the plurality of quadrifilar helix antenna elements; and a feed network adapted to feed the plurality of quadrifilar helix antenna elements, with the feed network including a microstrip feed circuitry associated with the second surface of the main board, and a first coaxial cable having a first length that bridges a first section of the microstrip feed circuitry and provides a first changeable time delay to a first portion of the plurality of quadrifilar helix antenna elements, and a second coaxial cable having a second length that bridges a second section of the microstrip feed circuitry and provides a second changeable time delay to a second portion of the plurality of quadrifilar helix antenna elements, with the second changeable time delay being an integer multiple of the first changeable time delay, wherein changing the first changeable time delay and the second changeable time delay results in a shift of the antenna.

14. The antenna as set forth in claim 13, wherein each of the quadrifilar helix antenna elements includes a phase-shifting circuit.

15. The antenna as set forth in claim 13, wherein the microstrip feed circuitry uses an equal line-length planar feed geometry.

16. The antenna as set forth in claim 13, wherein the first coaxial cable is connected to the first section of the microstrip feed circuitry using a first subminiature assembly connector, and the second coaxial cable is connected to the second section of the microstrip feed circuitry using a second subminiature assembly connector.

17. The antenna as set forth in claim 13, wherein the feed network includes a power divider circuit adapted to provide equal power to each quadrifilar helix antenna element.

18. A method of steering an antenna, wherein the antenna includes a plurality of elements cooperating as a phased array, and a feed network for feeding the elements, with a first portion of the feed network providing a first changeable time delay and a second portion of the feed network providing a second changeable time delay, the method comprising:

changing the first changeable time delay and the second changeable time delay to steer the antenna;

wherein the feed network includes a plurality of coaxial cables having a first set of lengths, and the step of changing the first changeable time delay and the second changeable time delay involves replacing one or more of the plurality of coaxial cables with one or more second coaxial cables having a second set of lengths.

* * * * *